United States Patent [19]

Hance

[11] 4,194,726

[45] Mar. 25, 1980

[54] CONCRETE LIFTER

[76] Inventor: Sammy M. Hance, 3939 D St., Sacramento, Calif. 95819

[21] Appl. No.: 888,911

[22] Filed: Mar. 22, 1978

[51] Int. Cl.[2] ..... B66F 11/00

[52] U.S. Cl. ..... 254/133 R

[58] Field of Search ..... 254/133, 134, 1

[56] References Cited

U.S. PATENT DOCUMENTS

| | | | |
|---|---|---|---|
| 136,156 | 2/1873 | Hake | 254/133 R |
| 3,300,183 | 1/1967 | Marshall | 254/133 R |

*Primary Examiner*—Robert C. Watson

*Attorney, Agent, or Firm*—Blair, Brown & Kreten

[57] ABSTRACT

Disclosed herein is an apparatus for inexpensively removing pieces of concrete and similar types of material from an installed location by means of an inverted F-shaped concrete remover. This remover has an additional leg parallel to the two horizontal legs that form the F but it is disposed at the extremity remote from the other horizontal legs in an opposite sense. A hydraulic jack is associated with this machine to provide pressure on the last named leg and remove portions of concrete.

6 Claims, 7 Drawing Figures

FIG. 1
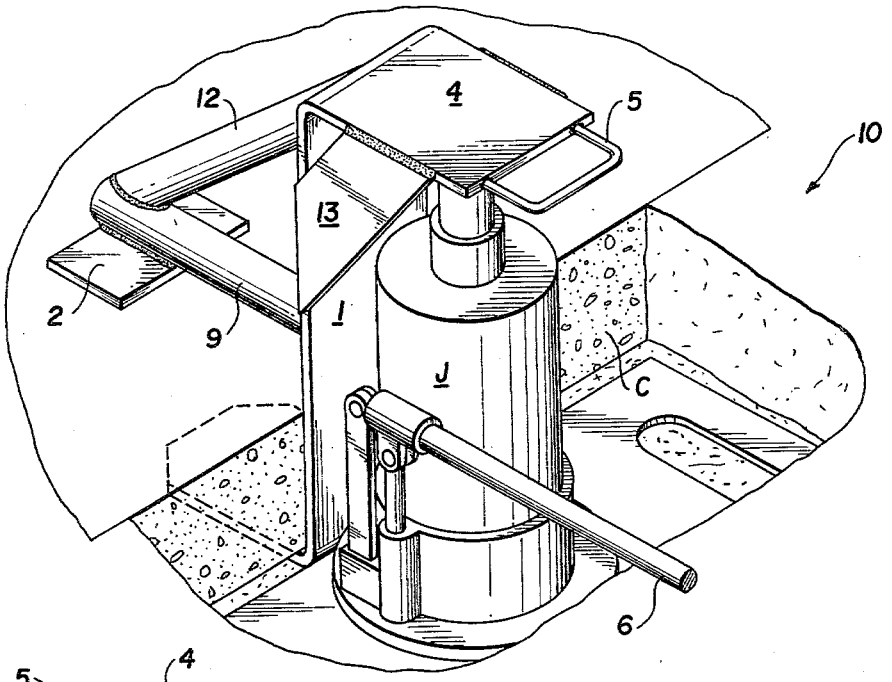
FIG. 2
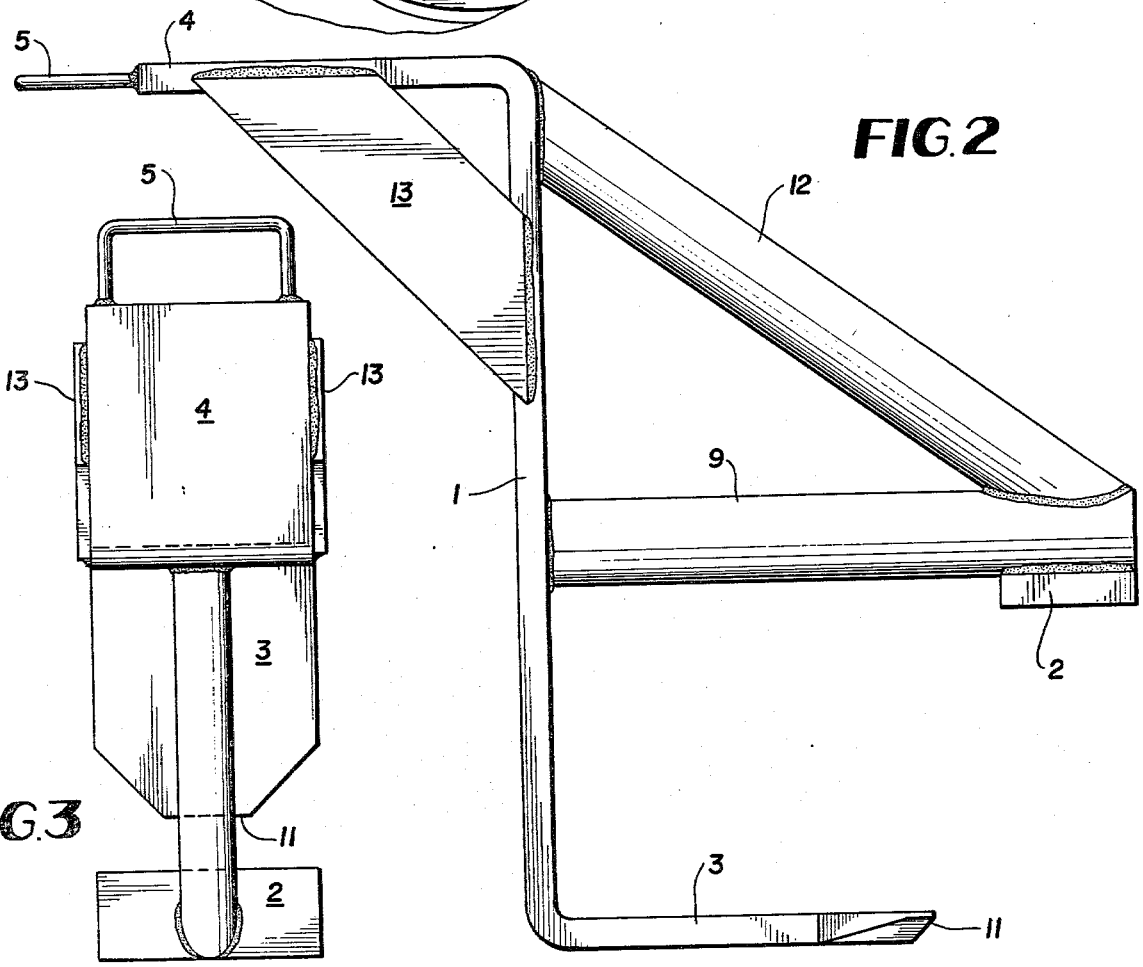
FIG. 3

CONCRETE LIFTER

BACKGROUND OF THE INVENTION

1. FIELD OF THE INVENTION

Mechanisms have existed for some time now which have been used to remove sections of concrete or uneven sections of concrete on highways and perhaps the one that comes to mind first would be the hydraulic jack hammer. To utilize this apparatus of course one needs a compressor and expeditures involved in operating this machine are quite substantive wherein compared to the mechanism according to the instant application.

In addition however applicant is aware of the following additional patents U.S. Pat. Nos. 1,148,856, 3,039,742, 3,394,634, 3,727,885 and 3,946,988. The patents to Pfundt and Kehren each utilize hydraulic type means in combination with a retaining chain for vertically raising column type objects, such as trees or poles. However none of the above identified patents is directed to hydraulic means in combination with an iron plate shown in the drawings. In addition there is no teaching found which disclosed the technique used according to the instant application for removing concrete.

2. OBJECT OF THE INVENTION

Accordingly it is an object of the invention to provide an inexpensive mechanism for removing portions of concrete.

Another object contemplates providing such a mechanism that can reliably and safely remove concrete portions.

Another object contemplates providing a durable structure for utilization and concrete removal.

These and other objects will be made manifest when considering the following detailed specification and drawings.

BRIEF DESCRIPTION OF THE DRAWINGS

FIG. 1 shows a perspective view of the apparatus according to the invention;

FIG. 2 shows a side view of the inverted F-shaped bracket structure according to the invention;

FIG. 3 is a top plan view of the apparatus of FIG. 2;

DESCRIPTION OF THE PREFERRED EMBODIMENT

Figure 4:
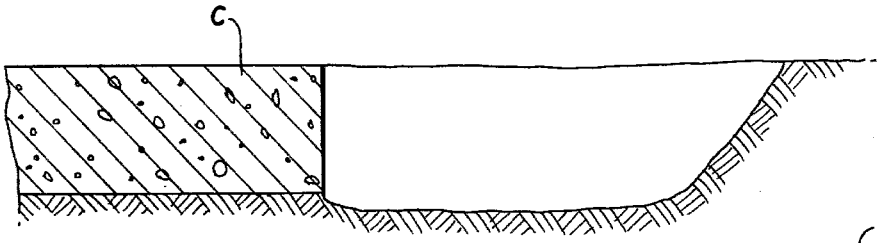
FIG. 4 depicts an environment for use with the apparatus according to the instant invention.

Referring to the drawings now wherein like reference numerals refer to like parts throughout the various drawings reference numeral 10 generally denotes the apparatus according to the present invention.

Figure 6:
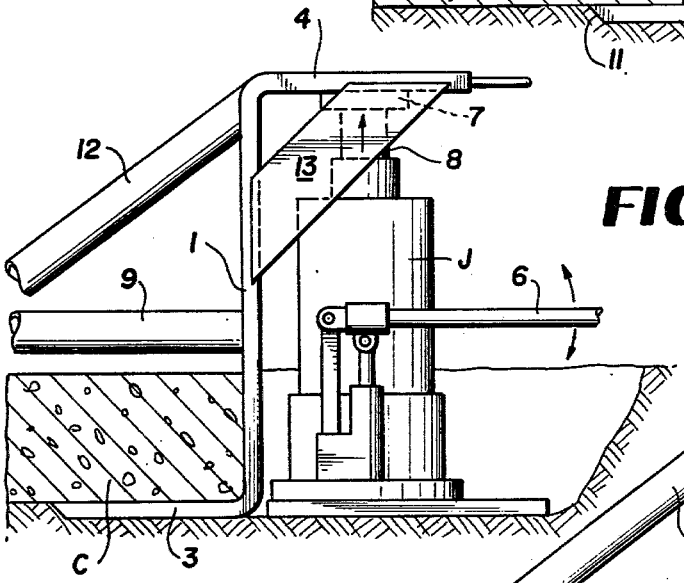
FIG. 6 shows installation of the hydraulic jack as the second step in breaking away a portion of concrete.
Figure 7:
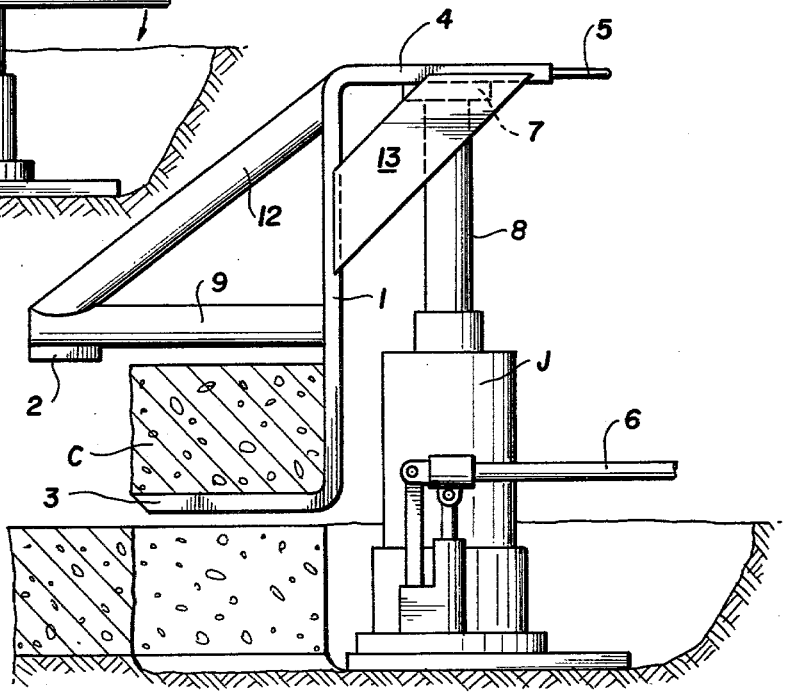
FIG. 7 shows the apparatus after having removed a portion of concrete.

This apparatus can generally be regarded as a bracket structure 1 of inverted F-shaped configuration having a vertical leg 1 from which legs 4 and 3 extend outwardly in a horizontal direction at the extremities of portion 1 in opposite sides of the member 1. Horizontal leg 3 has a sharpened point 11 and parallel to leg 3 is another arm element 2 which provides the third leg for the inverted F-shaped bracket. Arm element 2 is supported and carried by a supporting brace network comprised of tubing members 9 and 12 which when fastened to the vertical leg 1 form a right triangle. Tubular members 9 and 12 are welded or affixed to vertical leg 1 by any conventional manner and attached to each other at the extremity remote from vertical leg 1 also by welding or the like. The arm element 2 depends from the horizontal bar 9 and it is to be noted especially in FIG. 2 that the horizontal extent of depending arm 2 with bar 9 compared to leg 3 which tapers to point 11 has a greater extent. Extremity 4 of the bracket has disposed at its end remote from leg 1 a handle 5 whose purpose will be explained hereinafter. In operation, a portion is cleared away adjacent to concrete elements C as shown in FIG. 4, and the pointed edge 11 of the bracket is caused to ride underneath the concrete with leg 2 overriding the concrete. A sledge hammer H is used to drive the bracket below and above the concrete so as to ride thereover. FIG. 6 shows the inclusion of a conventional hydraulic jack J having a handle portion 6 and piston 8 with a platform 7. The platform 7 is caused to engage the bottom side of leg 4 of the bracket and applying the hydraulic pressure through handle 6 raises the piston as shown in FIG. 7 to a point where the concrete C will break off from the remaining portions of concrete and be lifted therefrom.

As has been previously noted, since the horizontal arm denoted by elements 9 and 2 are somewhat longer then the horizontal leg 3, application of the hydraulic jack will tend to provide a turning moment on the entire concrete lifter so that the moment arm will be effectively increased by having arm 2 acting further away from vertical leg 1 then does arm 3. In this situation, the handle 5 can be used to provide a grasping surface to carry away the concrete to a suitable vehicle.

Figure 5:
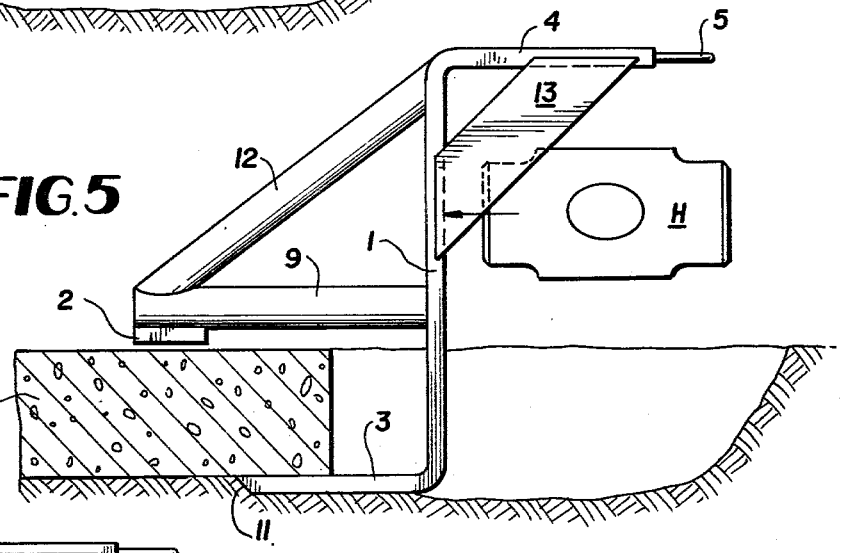
FIG. 5 shows stage one of the installation of the bracket according to the present invention.

It is to be noted that the leg 4 and its connection with vertical leg 1 is strengthened by brace elements 13 disposed on both sides of the concrete lifter as shown in FIG. 3 not only to provide additional support between vertical leg 1 and horizontal leg 4 but also to serve as a channel guideway restraint when the sledge hammer is being used to drive the block breaker under the concrete as best seen in FIG. 5.

Having thus described the invention, it will be appreciated that numerous structural variations are intended to be a part of this invention as set forth in the specification hereinabove and as defined hereinbelow by the claims.

What is claimed is:

1. A concrete removing device comprising bracket means suitably formed to engage a portion of concrete, and hydraulic jack means adapted to engage said bracket whereby when said jack is energized, said bracket moves a portion of the concrete relative to a remaining portion of concrete to thereby break off said portion of concrete, wherein said bracket means comprises a substantially inverted F-shaped element having two parallel legs extending in the same direction connected each to a vertical leg, and a fourth leg parallel to said first two legs but extending in a direction opposite from said first two legs.

2. The device of claim 1 wherein said jack nests under said fourth leg to provide the means for raising said bracket relative to a major portion of concrete.

3. The device of claim 2 in which a handle is disposed on said last named leg.

4. The device of claim 3 in which one of said two parallel legs has a greater extent than the other to provide a turning moment.

5. The device of claim 4 in which said longer leg is supported on said vertical leg by a diagonally disposed tubular arm.

6. The device of claim 5 in which a further brace is disposed between said vertical leg and fourth leg.

* * * * *